US007588519B2

(12) United States Patent
McClusky

(10) Patent No.: US 7,588,519 B2
(45) Date of Patent: Sep. 15, 2009

(54) EXERCISE WEIGHT SYSTEM

(76) Inventor: Scott McClusky, 15306 Douglas Pkwy., Lockport, IL (US) 60441

( * ) Notice: Subject to any disclaimer, the term of this patent is extended or adjusted under 35 U.S.C. 154(b) by 14 days.

(21) Appl. No.: 11/642,474

(22) Filed: Dec. 20, 2006

(65) Prior Publication Data

US 2008/0153678 A1 Jun. 26, 2008

(51) Int. Cl.
*A63B 21/06* (2006.01)
*A63B 21/072* (2006.01)

(52) U.S. Cl. ..... 482/93; 482/108; 482/106

(58) Field of Classification Search ..... 482/93, 482/106–109
See application file for complete search history.

(56) References Cited

U.S. PATENT DOCUMENTS 5,014,981 A * 5/1991 Prelich ..... 482/108
5,348,522 A * 9/1994 Brotman ..... 482/98
5,735,777 A * 4/1998 Benoit et al. ..... 482/93
7,052,447 B2 * 5/2006 Whittaker ..... 482/124
7,198,591 B2 * 4/2007 Lien ..... 482/106
2003/0017919 A1 * 1/2003 Lanoue ..... 482/107

* cited by examiner

*Primary Examiner*—Fenn C Mathew
(74) *Attorney, Agent, or Firm*—Nancy R. Gamburd; Jerome R. Drouillard; Gamburd Law Group LLC

(57) ABSTRACT

An exemplary incremental weight for an exercise system has a generally annular magnet encapsulated within a coating which cushions the magnet, protecting it both from becoming damaged, and from damaging an exercise apparatus, while promoting the adhesive properties of the magnet. In a first exemplary embodiment, the coating comprises a first annular rib and a second annular rib extending respectively about outer and inner peripheries of the generally annular magnet, and a plurality of ribs extending radially between the first and second annular ribs. The generally annular magnet, in exemplary embodiments, comprises at least one of a ceramic magnet, ferrite, or an alnico magnet. Exemplary coatings may be elastomeric, molded silicone, or anti-slip coatings. In another exemplary embodiment, a plurality of mounting pads are attached to a surface of said weight defined by an annular surface of said magnet.

20 Claims, 4 Drawing Sheets

EXERCISE WEIGHT SYSTEM

FIELD OF THE INVENTION

The field of the present invention relates to weight-bearing exercise equipment, and more specifically to incremental weight systems for easily adjusting the weight applied to weight training devices such as barbells, dumbbells, and flat plate machines.

BACKGROUND OF THE INVENTION

Individuals using weight training in a personal fitness regimen often desire to adjust the weight applied to any particular apparatus. Because most standard weight systems are adjustable only in 5 lb. increments, this presents a problem if a smaller adjustment increment is desired. The desire for smaller weights has given rise to auxiliary weights, such as those shown in U.S. Pat. Nos. 5,735,777 and 5,040,787. The weights described in U.S. Pat. No. 5,735,777 use several discrete magnets to attach a circular body to a magnetic weight training apparatus. Unfortunately, these discrete magnets do not generally provide sufficient retention force to keep the auxiliary weight of U.S. Pat. No. 5,735,777 adhered to a coated training apparatus such as a barbell, dumbbell, or plate apparatus coated with rubber or plastic. Moreover, the weight system disclosed in U.S. Pat. No. 5,040,787 suffers from the drawback that it is not generally compatible with existing weight training equipment, because special retention abutments must be formed in the auxiliary weights.

It would be desirable to have an exercise weight system with finer adjustment increments (micro-adjustability) sought by weight trainers, coupled with the ability to adhere to both coated and uncoated weight training apparatus.

BRIEF SUMMARY OF THE INVENTION

In a first embodiment of the present invention, an incremental weight for an exercise system includes an annular magnet encapsulated by a coating which covers at least a portion of the surface of said magnet. The annular magnet may be fabricated from either ferrite, or alnico, or from other magnetic materials as suggested by this disclosure and as otherwise may be known to those skilled in the art.

According to another embodiment of the invention a coating applied to the magnet may be composed of either an elastomer, such as silicone rubber, or other types of coatings, such as anti-slip coatings, and further may be filled with particulate material to increase its adhesion-promoting properties, also as suggested by this disclosure and as otherwise may be known to those skilled in the art.

According to another aspect of the present invention, elastomeric mounting pads may be attached to a surface of a weight defined by an annular surface of said magnet. Such mounting pads aid in maintaining the present inventive weight securely adhered to the surface of a weight training apparatus.

According to another aspect of the present invention, an exercise weight system preferably includes a primary weight training device and at least one incremental weight. The incremental weight is preferably configured as an annular magnet having a coating which encapsulates the surface of the magnet. The primary weight training device may be a dumbbell, a barbell, a flat plate apparatus, or other type of apparatus.

It is an advantage of an exercise weight system according to the present invention that micro-adjustment of a weight training apparatus may be achieved without the need for tools of any kind.

It is a further advantage of an exercise weight system according to the present invention that the present incremental weights may be employed with both coated and uncoated primary weights, without the danger of scratching delicate plated surfaces. This is a decided advantage when primary weights are plated with chrome or other metals.

It is a further advantage of the present exercise weight system that the inventive incremental weights may be stacked upon one another, so as to increase their versatility, as compared with known incremental or auxiliary weights.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, in which.

DETAILED DESCRIPTION OF EXEMPLARY EMBODIMENTS

Figure 1:
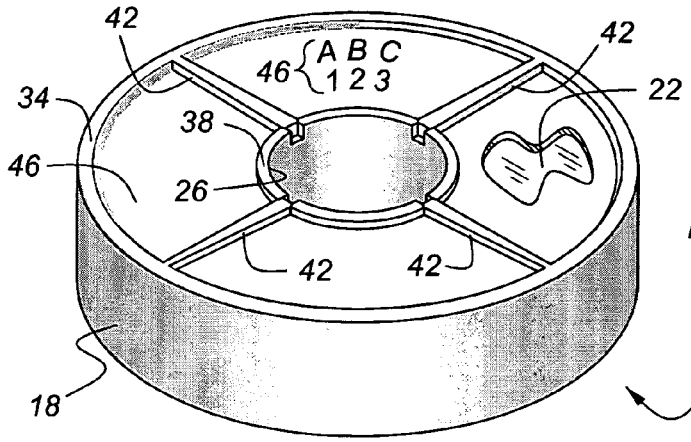
FIG. 1 is a perspective view of a first exemplary embodiment of an incremental weight according to the teachings of the present invention.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, or as described and illustrated in the drawings. Apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

Figure 2:
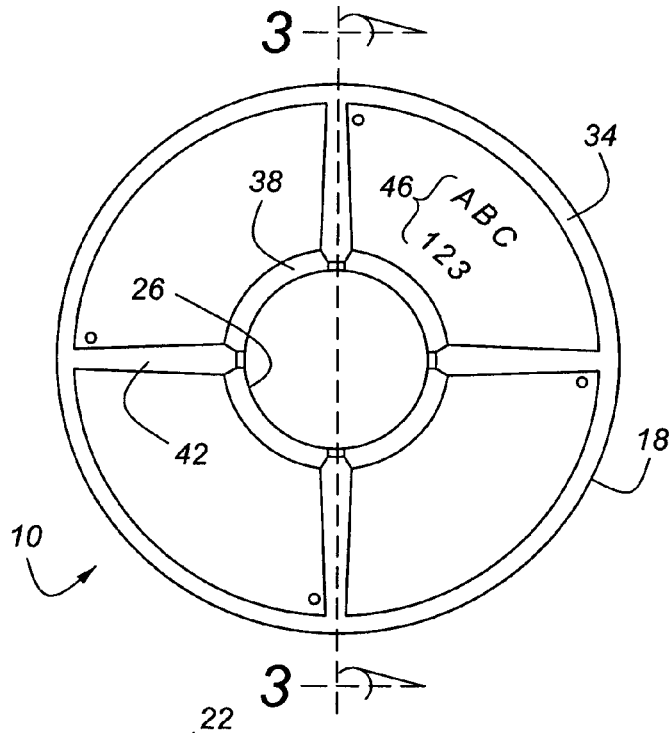
FIG. 2 is a plan view of the first exemplary incremental weight shown in FIG. 1.
Figure 3:
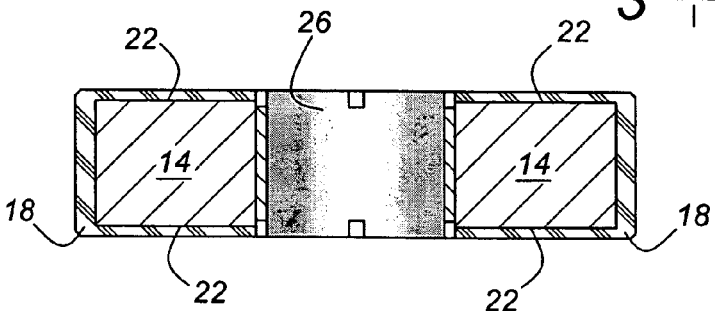
FIG. 3 is a sectional view of the inventive first exemplary incremental weight of FIGS. 1 and 2, taken along the line 3-3 of FIG. 2.

As shown in FIGS. 1 and 2, in a first embodiment, incremental weight 10 has a generally annular configuration. The annular configuration of weight 10 results in part from the annular configuration of generally annular magnet 14, which is shown in section in FIG. 3. Magnet 14 has two annular faces, 22 (illustrated through a cut-away section of coating 18), and a central bore, 26. Magnet 14 may be fabricated from a variety of suitable magnetic materials as suggested by this disclosure and as otherwise may be known to those skilled in the art. Such materials include, without limitation, ferrite, alnico, and other materials. Because magnet 14 occupies practically the entire space within incremental weight 10, the present inventive weight exhibits vastly superior magnetic properties, and concomitant superior adhesion characteristics, as compared with known incremental weights.

Coating 18 preferably encapsulates the entire surface of magnet 14. Coating 18 may be selected from groups of coatings including, without limitation, elastomers such as silicone rubber, plastics, and other coatings as suggested by this disclosure and as otherwise may be known to those skilled in the art. In an exemplary embodiment, coating 18 may be filled with particulate material to increase its adhesion-promoting properties.

When formulated from molded silicone rubber according to a selected embodiment, coating 18 enhances the durability of incremental weight 10 by providing a protective cushion, which is important if weight 10 utilizes a ceramic magnet, such as a ferrite magnet. In the case in which coating 18 is formed from silicone rubber, this will help to protect magnet 14 from damage if weight 10 is accidentally dropped.

In addition to protecting magnet 14, coating 18 also provides increased adhesion, in the form of an anti-slip characteristic, to weight 10. This increased adhesion results from the inherent friction promoting performance of the silicone, as well as from the friction promoting characteristic of first, or outer, annular, rib, 34, which is formed integrally in coating 18, and which extends about the outer periphery of annular surface 22 of magnet 14, as well as from second, or inner, annular rib 38, extending about the inner periphery of magnet 14. Ribs 34 and 38 are especially useful for promoting adhesion to smooth-sided primary weight training devices. Radial ribs 42 work in concert with ribs 34 and 38 to promote adhesion of weight 10. Ribs 34, 38, and 42 also work to prevent unwanted harshness when weight 10 is moved rapidly into contact with a device such as a dumbbell or barbell. As mentioned above, in an exemplary embodiment, coating 18 may be filled with particulate material to increase its adhesion-promoting properties.

Ribs 34, 36, and 42 offer yet another advantage, as they provide an amount of axially extending clearance sufficient to permit indicia, shown generally at 46 of FIG. 1, to be printed in raised type upon coating 18 without impairing the adhesion characteristics of weight 10. Such indicia may include an advisory such as a preferred polarity for attachment of weight 10.

Figure 4:
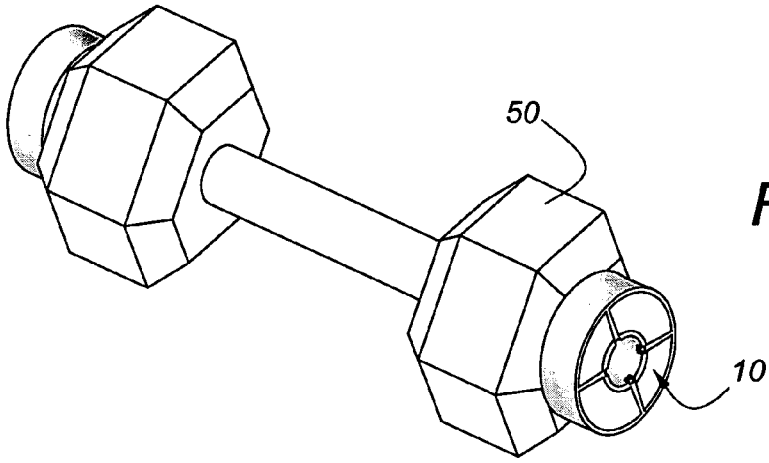
FIG. 4 is a perspective view illustrating the first exemplary incremental weight, as applied to a first type of dumbbell.
Figure 5:
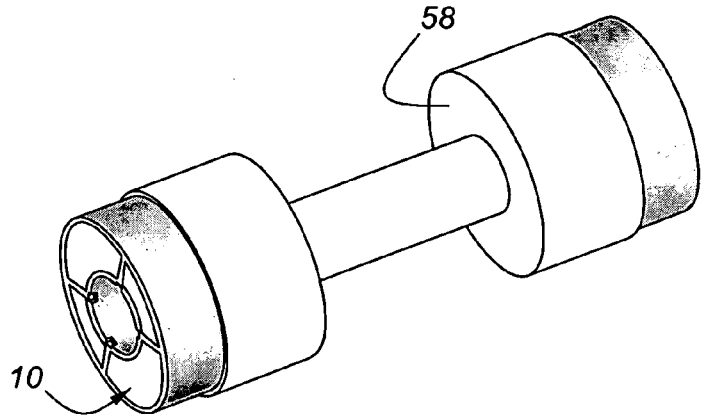
FIG. 5 is a perspective view illustrating the first exemplary incremental weight, as applied to a second type of dumbbell.
Figure 6:
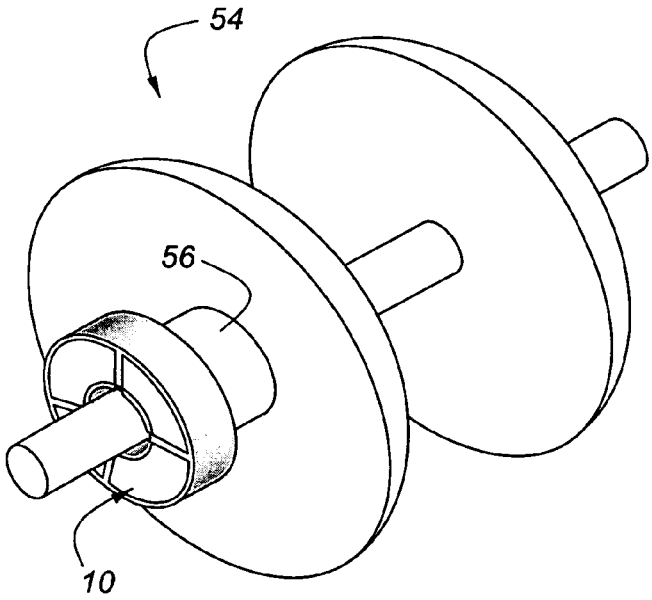
FIG. 6 is a perspective view illustrating the first exemplary incremental weight, as applied to a barbell.
Figure 7:
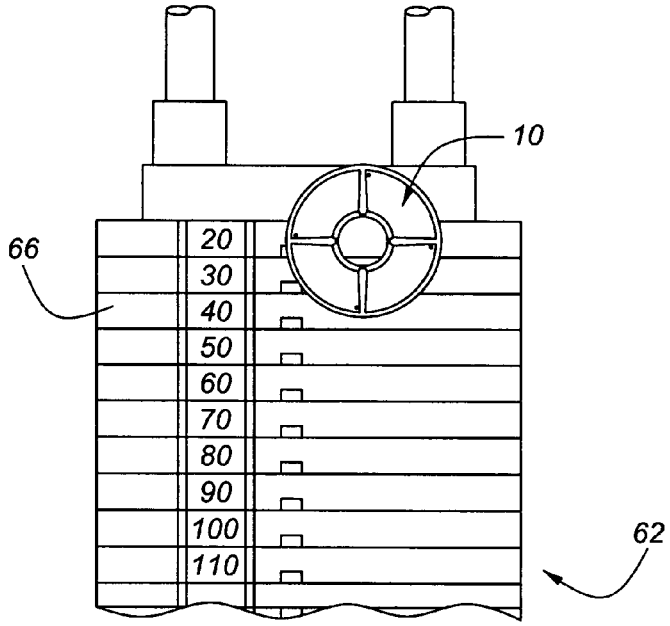
FIG. 7 is an elevation (or side) view illustrating the first exemplary incremental weight, as applied to a weight training apparatus utilizing flat plate weights.

The present incremental weight may advantageously be provided as a component part of an exercise system including not only one or more incremental weights 10, but also one or more primary weight training devices. Accordingly, FIGS. 4 and 5 illustrate incremental weight 10 applied to dumbbells 50 and 58. The tenacious grip provided by magnet 14 maintains incremental weight 10 securely in contact with these and other known dumbbells. FIG. 6 shows weight 10 applied to collar 56 of barbell 54, with the weight 10 being attracted magnetically to the iron or steel collar 56. Finally, FIG. 7 shows incremental weight 10 applied to flat plates 66 of plate apparatus 62.

Figure 8:
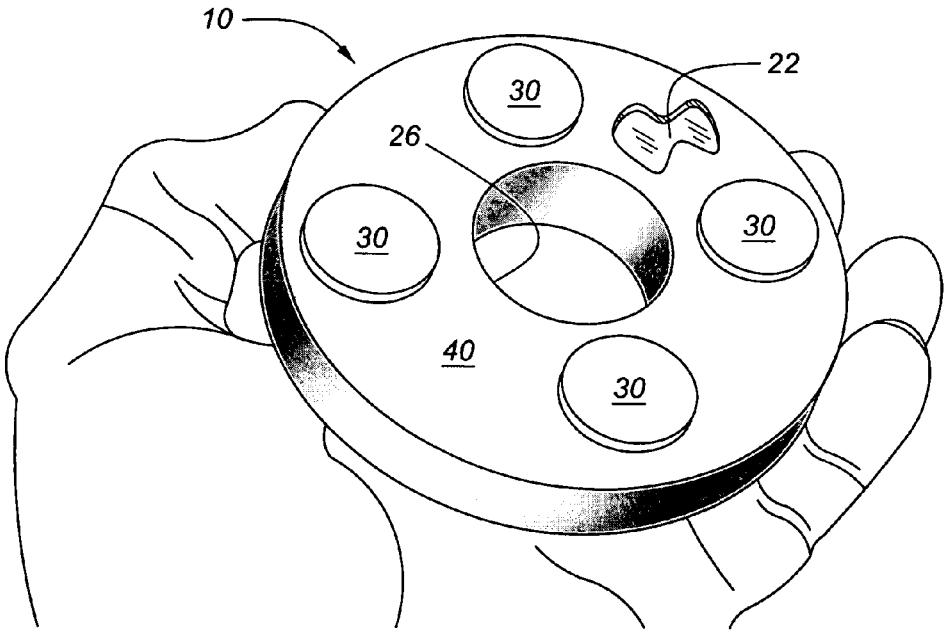
FIG. 8 is a perspective view illustrating a second exemplary incremental weight embodiment having mounting pads according to one aspect of the present invention.

In the second embodiment of FIG. 8, a number of mounting pads 30, which may be fabricated from silicone rubber or other suitable friction promoting material, are applied to or integrated with an annular surface 40 of weight 10 defined by annular surface 22 of magnet 14. Pads 30 enhance the non-slip capability of coating 18.

Figure 9:
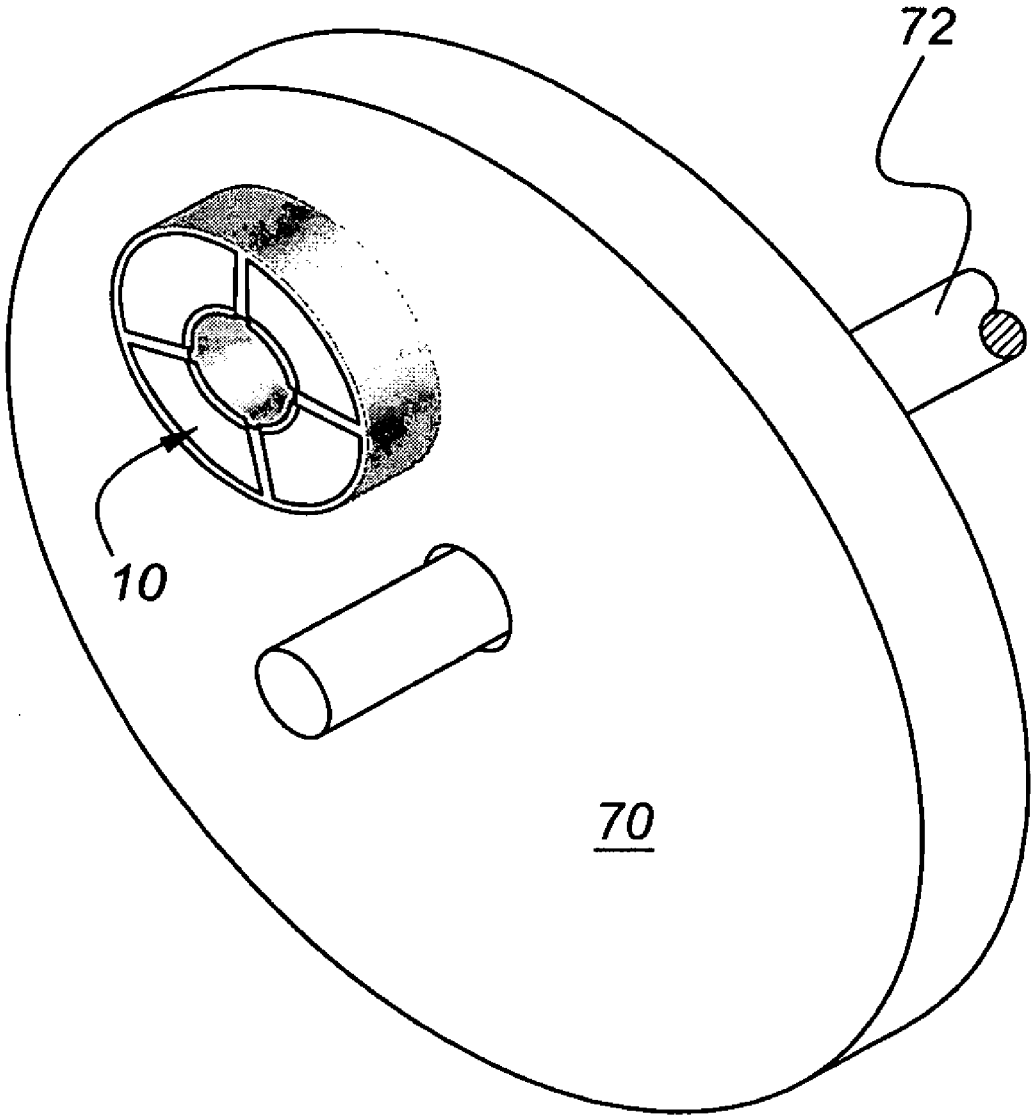
FIG. 9 is a perspective view illustrating an incremental weight embodiment according to the present invention applied to an Olympic Plate primary weight.

FIG. 9 displays yet another exemplary use for the present inventive incremental weight. As seen in FIG. 9, incremental weight 10 adheres readily to the slab sides of Olympic Plate primary weights.

Although the invention has been described with respect to specific embodiments thereof, these embodiments are merely illustrative and not restrictive of the invention. In the description herein, numerous specific details are provided, such as examples of structural components, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

In addition, use of the term the disjunctive term "or" herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. An incremental weight for an exercise system comprising:

a unitary annular magnet having an annular surface; and a non-magnetic coating encapsulating at least a portion of said annular surface of said magnet, the coating having an integrally formed extension from said annular surface to form an adhesion surface.

2. An incremental weight according to claim 1, wherein said annular magnet comprises a ceramic magnet.

3. An incremental weight according to claim 1, wherein said ceramic magnet comprises ferrite.

4. An incremental weight system according to claim 1, wherein said annular magnet comprises an alnico magnet.

5. An incremental weight system according to claim 1, wherein said coating comprises an elastomer.

6. An incremental weight system according to claim 1, wherein said coating comprises molded silicone.

7. An incremental weight system according to claim 1, wherein said coating further comprises an anti-slip coating.

8. An incremental weight system according to claim 1, wherein said integrally formed extension of said coating comprises a plurality of mounting pads attached to a surface of said weight defined by an annular surface of said magnet.

9. An incremental weight system according to claim 8, wherein said mounting pads comprise an elastomer.

10. An incremental weight system according to claim 1, wherein said coating encapsulates the entire surface of said generally annular magnet.

11. An incremental weight system according to claim 1, wherein said integrally formed extension of said coating comprises at least one annular rib extending about an outer periphery of said generally annular magnet.

12. An incremental weight system according to claim 1, wherein said integrally formed extension of said coating comprises at least a first annular rib extending about an outer periphery of said generally annular magnet, and at least a second annular rib extending about an inner periphery of said generally annular magnet.

13. An incremental weight system according to claim 12, wherein said integrally formed extension of said coating further comprises a plurality of ribs extending radially between said first annular rib and said second annular rib.

14. An incremental weight system according to claim 1, wherein said coating comprises a polarity indexing indicium.

15. A weight training system, comprising:

a primary weight training device fabricated at least in part from ferrous material; and at least one incremental weight which may be applied selectively to said primary weight training device, with said incremental weight comprising:

a unitary annular magnet having an annular surface; and a non-magnetic coating encapsulating at least a portion of said annular surface of said magnet, the coating having an integrally formed extension from said annular surface to form an adhesion surface.

16. A weight training system according to claim 15, wherein said primary weight training device comprises a dumbbell.

17. A weight training system according to claim 15, wherein said primary weight training device comprises a barbell.

18. A weight training system according to claim 15, wherein said primary weight training device comprises a flat plate apparatus.

19. A weight training system according to claim 15, wherein said coating comprises an elastomeric coating having a plurality of generally annular ribs extending about inner and outer peripheries of said generally annular magnet.

20. An incremental weight for an exercise system, comprising:

a unitary annular magnet having a surface, said unitary annular magnet comprising at least one of: a ceramic magnet, ferrite, or an alnico magnet; and an a non-magnetic elastomeric coating encapsulating the surface of said magnet, said non-magnetic elastomeric coating comprising a first annular rib extending from the surface and about an outer periphery of said unitary annular magnet, a second annular rib extending from the surface and about an inner periphery of said unitary annular magnet, and a plurality of radial ribs extending from the surface of said unitary annular magnet and radially between said first annular rib and said second annular rib.

* * * * *